US007512372B2

(12) United States Patent
Burton et al.

(10) Patent No.: US 7,512,372 B2
(45) Date of Patent: Mar. 31, 2009

(54) TEMPERATURE-CHANGING PRESSURE ROLLER ASSEMBLY AND A FUSING APPARATUS HAVING SAME

(75) Inventors: William A Burton, Rochester, NY (US); Paul M Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 102 days.

(21) Appl. No.: 11/567,819

(22) Filed: Dec. 7, 2006

(65) Prior Publication Data

US 2008/0138122 A1 Jun. 12, 2008

(51) Int. Cl.
*G03G 15/20* (2006.01)

(52) U.S. Cl. ..... 399/331; 399/69; 399/328

(58) Field of Classification Search ..... 399/69, 399/92, 320, 328, 331; 347/156
See application file for complete search history.

(56) References Cited

U.S. PATENT DOCUMENTS 3,717,409 A * 2/1973 Hespenheide ..... 399/359
4,397,154 A 8/1983 Bowers, Jr.
4,977,431 A 12/1990 Fuji
5,099,281 A * 3/1992 Bhagat ..... 399/147
5,247,336 A 9/1993 Mills, III
5,325,164 A * 6/1994 Tai et al. ..... 399/331 X
5,461,868 A 10/1995 Finko
5,918,087 A 6/1999 Kimura et al.
5,987,295 A * 11/1999 Matsuo et al. ..... 399/331 X
5,991,564 A 11/1999 Ni
6,754,457 B2 * 6/2004 Ciaschi et al. ..... 399/92
7,031,626 B1 * 4/2006 Stelter et al. ..... 399/69 X

* cited by examiner

*Primary Examiner*—Sandra L Brase
(74) *Attorney, Agent, or Firm*—Tallam I. Nguti

(57) ABSTRACT

A temperature-changing pressure roller assembly is provided and includes (a) a rotatable pressure roller including a cylindrical sleeve having an outer surface, and an inner surface defining a hollow interior to the rotatable pressure roller having a first end and a second and opposite end; (b) a vortex tube assembly for simultaneously producing a hot air stream and a cold air stream, the vortex tube assembly being connected to the hollow interior of the rotatable pressure roll; and (c) control device connected to the vortex tube assembly for selectively controlling flow of the hot air stream and the cold air stream thereof through the hollow interior of the rotatable pressure roller, thereby selectively changing a temperature of the cylindrical sleeve of the pressure roller.

20 Claims, 3 Drawing Sheets

TEMPERATURE-CHANGING PRESSURE ROLLER ASSEMBLY AND A FUSING APPARATUS HAVING SAME

The present invention relates to an electrostatographic reproducing machine and, more particularly, to such a machine including a fusing apparatus having a temperature-changing pressure roller assembly.

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is cleaned and prepared to be used once again for the reproduction of a copy of an original. The paper with the powdered toner thereon in image-wise configuration is separated from the photoreceptor and moved through a fuser apparatus to permanently fix or fuse the toner image to the paper.

One approach to fixing, or "fusing", the toner image is applying heat and pressure by passing the copy sheet carrying the unfused toner image between a pair of opposed roller members of a fusing apparatus, at least one of the rollers (fuser roller) is heated and the other is a pressure roller. During this procedure, the temperature of the toner material is elevated to a temperature at that the toner material coalesces and becomes tacky. This heating causes the toner to flow to some extent into the fibers or pores of the sheet. Thereafter, as the toner material cools, solidification of the toner material causes the toner material to become bonded to the sheet.

Dry ink or toner fusing apparatus use heat and pressure in a heated fuser and pressure roller arrangement, for example, to heat, melt and press-bond or fix the melted ink or toner onto the surface of a substrate or sheet. In such a fusing apparatus, the pressure roller needs to be initially heated along with the heated fuser roller in order to quickly warm up the fusing nip and thus reduce the time-to-first-print measure of the fusing apparatus. Subsequently however, in a duplexing machine that forms a first toner image on side 1 of the sheet (that is first fused in a first pass through the fusing nip), and a second toner image thereafter on side 2 of the sheet (that is fused subsequently during a second pass of the sheet through the fusing nip), the pressure roller may need to be cooled then (after such initial warm up heating) in order to avoid over fusing and related defects in the side 1 image. In such cases, it is believed improved pressure roller cooling will reduce the temperature of the sheet leaving the fusing nip, and thus will reduce such related over-fusing image defects.

Also in the case of simplex printing, cooling the pressure roll to below its unregulated temperature will allow control of the average or bulk sheet temperature. Modification of the bulk sheet temperature in this manner can have many benefits including reduction of image quality artifacts such as gloss streaks or spots. Additionally, lower bulk sheet temperatures also reduce heat load in the rest of the machine besides also making the sheets in the exit try more comfortable to handle.

As disclosed in the following patents, several other reasons have been advanced for desiring to control the temperatures of both the heated fuser roller and of the pressure roller in a roller fusing or fixing apparatus. The examples also show that the vortex heating and cooling principles have been successfully adapted elsewhere for inventive heating and cooling applications. For example, U.S. Pat. No. 5,461,868 issued Oct. 31, 1995 and entitled "Method and device for gas cooling" discloses a method for gas cooling with the use of a vortex tube into which the gas to be cooled is admitted through a scroll, where the gas is swirled and accelerated, and is expanded at the inlet of the vortex tube, then is divided into a peripheral part and an axial part, the peripheral part of the gas stream being discharged from the cooler along curvilinear pathways which are joined together with the pathway of motion of the gas stream over the tube walls, without formation of standing waves. A gas cooler comprises a scroll (1), an expansion chamber (2), and outlets for the peripheral and axial parts of the gas stream, wherein the peripheral part of the gas stream is discharged either through curvilinear ports (7) made in the wall of the expansion chamber, or through a second scroll (11). The gas which has passed through the second scroll is joined with the axial part of the gas stream.

U.S. Pat. No. 4,397,154 issued Aug. 9, 1983 and entitled "vortex gas cooler" discloses a vortex gas cooler having a compound fan which directly generates two gas stream vortex flows required for cooler operation.

U.S. Pat. No. 5,247,336 issued Sep. 21, 1993 and entitled "Image fusing apparatus having heating and cooling devices" discloses a fusing apparatus for fusing toner images onto a substrate. The fusing apparatus includes a heated first fusing member, a second timing member and a fusing mix formed by the first and second members. A substrate carrying an unfused toner image on a first side thereof is routed through the fusing nip such that the unfused toner image directly faces the heated first member, and the second side thereof directly faces the second fusing member. In order to prevent melting or re-melting of a toner image on such second side, the fusing apparatus includes a device for cooling and maintaining the temperature of the second fusing member at a point below the melting temperature of toner particles forming the image on such second side.

U.S. Pat. No. 5,991,564 issued Nov. 23, 1999 and entitled "Electrophotographic duplex printing media system" discloses a method and system media sheet handling in an electrophotographic color desktop printer are disclosed wherein a media sheet is imaged with toner on both sides of the media sheet without smudging or re-melting the images. The temperature of the fusing roller and the pressure roller are controlled to keep the pressure roller temperature below the toner cold offset temperature.

U.S. Pat. No. 5,918,087 issued Jun. 29, 1999 and entitled "Image forming apparatus" discloses an image forming apparatus including a fixing roller and a pressure roller in which a temperature of the fixing roller and/or the pressure roller is changed differently depending on an operation mode. In particular, the temperature of the fixing roller and/or pressure roller of an operation of a non-full color mode is changed to a lesser degree than that of a full color mode operation. In another embodiment of the present invention, the temperature of the fixing roller is set to an appropriate value when an environment temperature sensor is not working properly, to produce high quality images. In yet another embodiment according to the present invention, the temperature of the fixing roller is set to an appropriate value, when an image forming apparatus is turned off for a predetermined period of time, to produce high quality images.

U.S. Pat. No. 4,977,431 issued December, 1990 and entitled "Fixing apparatus and method of controlling temperature of the same" discloses a fixing apparatus detects the surface temperature of a heat roller, detects either the temperature of a press roller which press-contacts the heat roller and incorporates a heater, or the temperature of an external heating apparatus which heats the exterior of the heat roller.

The fixing apparatus controls the heater of the above-mentioned press roller or the above-mentioned external heating apparatus based on the results of these detections, and thereby performs a high-quality fixing operation without damaging the heat roller.

In accordance with the present disclosure, there has been provided a temperature-changing pressure roller assembly that includes (a) a rotatable pressure roller including a cylindrical sleeve having an outer surface, and an inner surface defining a hollow interior to the rotatable pressure roller having a first end and a second and opposite end; (b) a vortex tube assembly for simultaneously producing a hot air stream and a cold air stream, the vortex tube assembly being connected to the hollow interior of the rotatable pressure roll; and (c) control device connected to the vortex tube assembly for selectively controlling flow of the hot air stream and the cold air stream thereof through the hollow interior of the rotatable pressure roller, thereby selectively changing a temperature of the cylindrical sleeve of the pressure roller.

Figure 1:
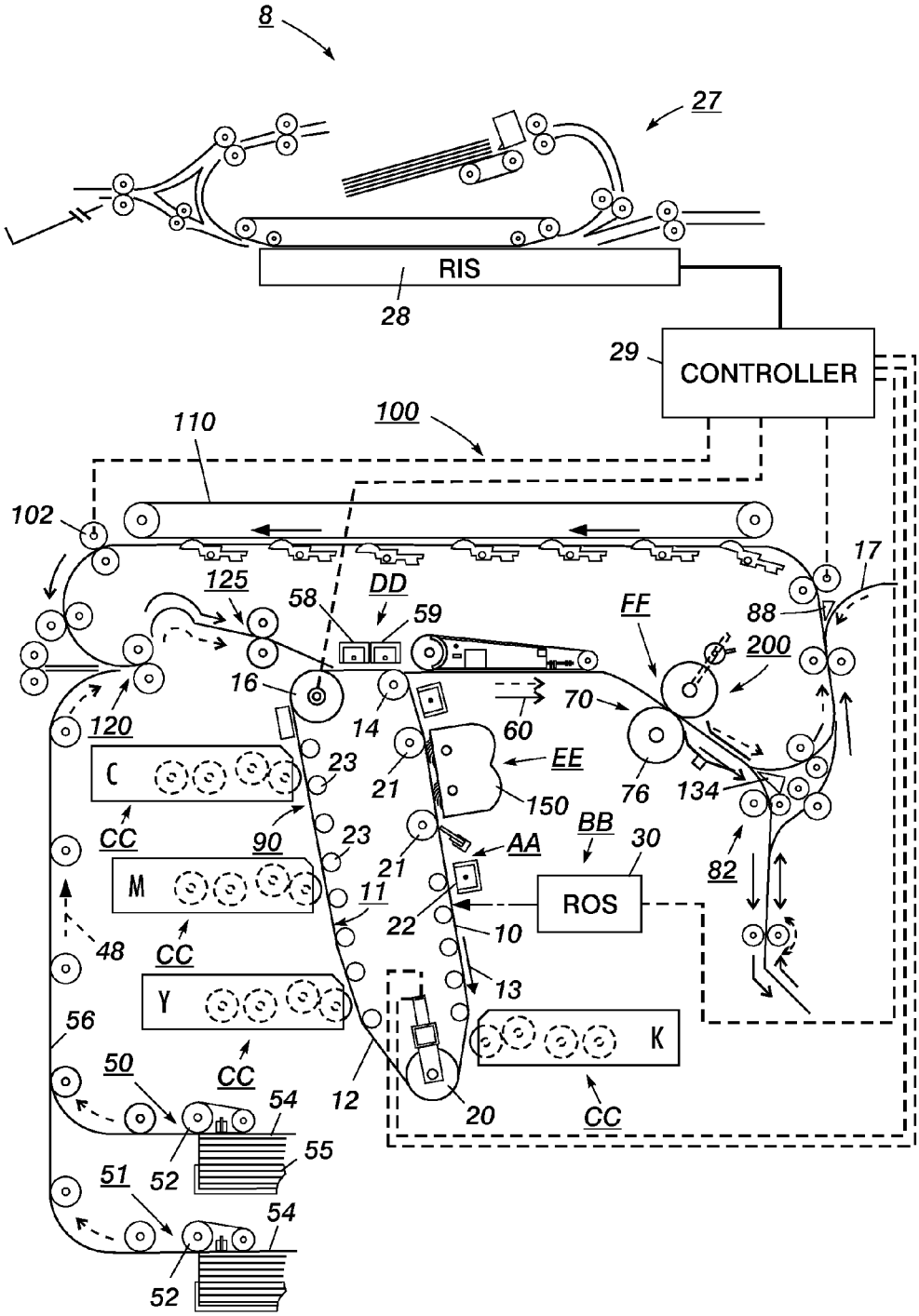
FIG. 1 is a schematic elevational view of an exemplary electrostatographic reproduction machine including a fusing apparatus having the temperature-changing pressure roller assembly of the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roller 14, drive roller 16, idler roller 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 54 is advanced to the transfer station DD, by a sheet feeding apparatus 50. Sheet-feeding apparatus 50 may include a corrugated vacuum feeder (TCVF) assembly 52 for contacting the uppermost sheet 54 of stack 55. TCVF 52 acquires each top sheet 54 and advances it to vertical transport 56. Vertical transport 56 directs the advancing sheet 54 through feed rolls 120 into registration transport 125, then into image transfer station DD to receive an image from photoreceptor belt 10 in a timed and registered manner. Transfer station DD typically includes a corona-generating device 58 that sprays ions onto the backside of sheet 54. This assists in attracting the toner powder image from photoconductive surface 12 to sheet 54. After transfer, sheet 54 continues to move in the direction of arrow 60 where it is picked up by a pre-fuser transport assembly and forwarded to fusing station FF. Fusing station FF includes the fusing apparatus indicated generally by the reference numeral 70 that has the temperature-changing pressure roller assembly 200 of the present disclosure (to be described in detail below) for fusing and permanently affixing the transferred toner powder image 213 to the copy sheet 54.

After fusing and permanently affixing the transferred toner powder image 213 as such, the sheet 54 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed there from by a cleaning apparatus 150 at cleaning station EE.

Figure 2:
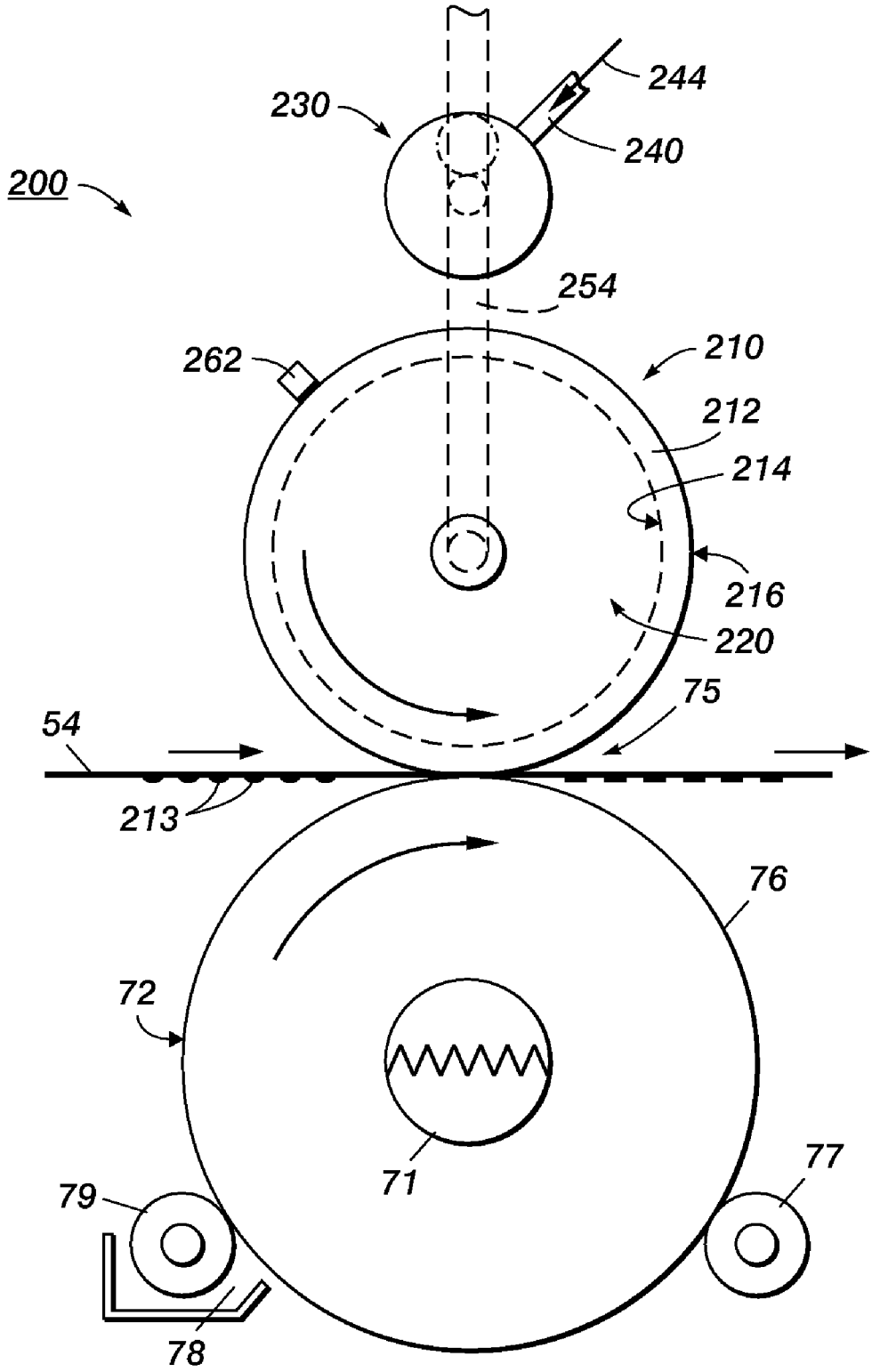
FIG. 2 is an enlarged end section schematic of the fusing apparatus of FIG. 1 showing the temperature-changing pressure roller assembly of the present disclosure.
Figure 3:
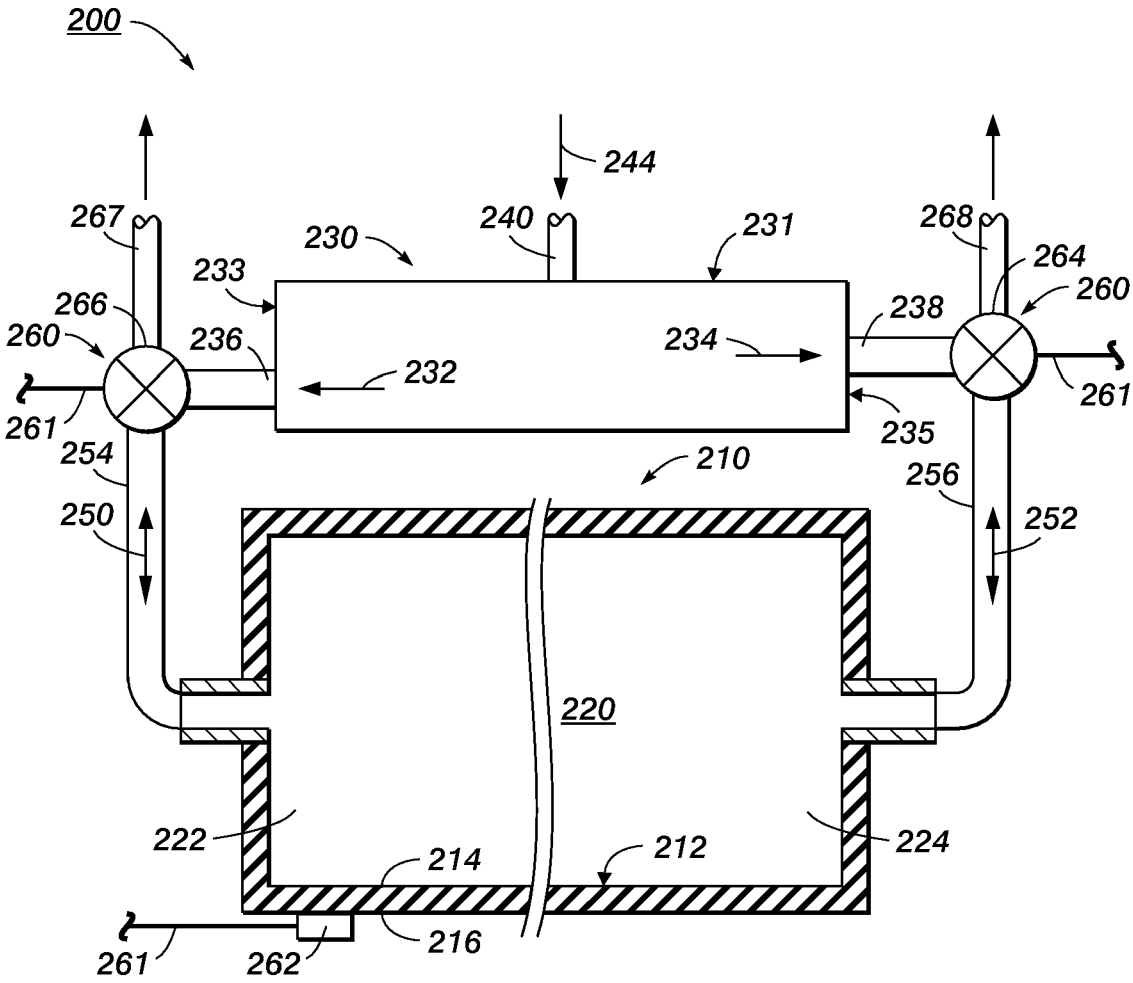
FIG. 3 is a side section in part showing the temperature-changing pressure roller assembly of FIG. 2 in accordance with the present disclosure.

Referring now to FIGS. 1-3, the fusing apparatus includes a heated fuser roller 72 having a first outer surface 76 and the temperature-changing pressure roller assembly 200 of the present disclosure. As shown, the temperature-changing pressure roller assembly 200 includes a rotatable pressure roller 210 that is comprised of a cylindrical sleeve 212. The cylindrical sleeve 212 is made of a heat conductive material, has a second outer surface 216, and an inner surface 214 defining a hollow interior 220 to the rotatable pressure roller 210. The hollow interior 220 has a first end 222 and a second and opposite end 224 as shown. The second outer surface 216 of the rotatable pressure roller forms a fusing nip 75 through which the sheet 54 is passed with the powder image 213 on the copy sheet 54 contacting fuser roller 72. The temperature-changing pressure roller assembly 200 is loaded against the fuser roller 72 forming the fusing nip 75 for providing the necessary pressure to fix the heated toner powder image 213 to the copy sheet. The fuser roller 72 for example is internally heated by a quartz lamp 71. The fuser roller and first outer surface 76 may be cleaned by a roller 77, and release agent, stored in a reservoir 78 that is pumped to a metering roller 79 for application to the surface of the fuser roller after the sheet is stripped from such surface.

As also shown, the temperature-changing pressure roller assembly 200 further includes a vortex tube assembly 230 for simultaneously producing a hot air stream 232 and a cold air stream 234. The vortex tube assembly 230 as illustrated includes a hot air stream outlet port 236, a cold air stream outlet port 238, and a compressed air inlet port 240. In the temperature-changing pressure roller assembly 200, a source of compressed air (not shown) is connected to the compressed air inlet port 240 for supplying compressed air 244 to the vortex tube assembly 230. The compressed air 244 is supplied at a pressure, for example, of about 80 psi.

As is well known in general, a vortex tube 231 (also known as the Ranque-Hilsch vortex tube), is a specially designed device with a tubular chamber into which (in this disclosure) compressed or pressurized air 244 is injected. The chamber's internal shape, combined with the pressure, accelerates the compressed air to a high rate of rotation (over 1,000,000 rpm). The air under these conditions is split into two streams, one giving kinetic energy to the other, and resulting in separate flows of a hot air stream 232 and a cold air stream 234. More specifically, the compressed air 244 injected into the vortex tube 231 under such conditions creates a cyclone, or vortex that is spinning at speeds of about a million revolutions per minute. Some of the air is forced to spin inward towards the center of the tube and to travel up the tube as a spinning column that then turns inside itself resulting in two columns, an outside column traveling one way and an inside column traveling the other way. Under these conditions, the inside column of air gives up its heat to the outside column and becomes cold while the outside column becomes hot. The cold air can then be directed out one end 233 of the vortex tube and the hot air can be directed out the other end 235 of the vortex tube. The air flows as such, and the temperatures are totally controllable.

As further illustrated, the vortex tube 231 is connected to the hollow interior 220 of the rotatable pressure roller 210, for example one end 233 thereof to the first end 222 of the hollow interior, and the other end 235 to the second end 224 of the hollow interior. The hot air stream 232 and cold air stream 234 are selectively controllable to flow through the hollow interior 220 and against the inner surface 214 of the rotatable pressure roller 210 thus selectively heating or cooling the pressure roller 210. The temperature-changing pressure roller assembly 200 also includes a first set of air flow conduits 254 connecting the hot air stream outlet port 236 to the hollow interior 220 of the rotatable pressure roller, and a second set of air flow conduits 256 connecting the cold air stream outlet port 238 to the hollow interior 220 of the rotatable pressure roller.

The temperature-changing pressure roller assembly 200 further includes control means 260 that are connected to the vortex tube assembly 230 for selectively controlling flow of the hot air stream 232 and the cold air stream 234 thereof through the hollow interior 220 of the rotatable pressure roller, thereby selectively changing a temperature of the cylindrical sleeve 212 of the pressure roller. The control means 260 are connected by means 261 to the controller 29, and include a temperature sensor 262 positioned on the second outer surface 216 of the cylindrical sleeve 212 for controlling operation of the vortex tube assembly 230. The control means also includes a first 3-way control valve 264 connected via 261 to the controller 29 and coupled to the second set of conduits 256 for controlling the flow of the cold air stream 234 either into and through the hollow interior 220 or directly out through a second vent 268. Similarly, a second 3-way control valve 266 is also connected via 261 to the controller 29 and coupled to the first set of conduits 254 for controlling the flow of the hot air stream 232 either into and through the hollow interior 220 or directly out through a first vent 267.

Thus to recap, in a fusing apparatus including a heated fuser roller and a pressure roller, a vortex device is coupled as an assembly to the pressure roller and is used to heat or cool the pressure roller. Through the use of separate air flow ducts or conduits and 3-way air valves as illustrated, the vortex device can be used to heat the pressure roller during preliminary pressure roller warm-up, but also selectively to cool the pressure roller at any desired period after the fusing apparatus has reached fusing set point temperature, for example to prevent over-fusing (by the pressure roller) of a second side pre-fused second side image. Or, in general to control the average or bulk sheet temperature of sheets passing through the fuser. Through the use of the 3 way valves as shown, the cooling or heating air streams can be routed through the pressure roller first and/or vented as shown.

As can be seen, there has been provided a temperature-changing pressure roller assembly that includes (a) a rotatable pressure roller including a cylindrical sleeve having an outer surface, and an inner surface defining a hollow interior to the rotatable pressure roller having a first end and a second and opposite end; (b) a vortex tube assembly for simultaneously producing a hot air stream and a cold air stream, the vortex tube assembly being connected to the hollow interior of the rotatable pressure roll; and (c) control device connected to the vortex tube assembly for selectively controlling flow of the hot air stream and the cold air stream thereof through the hollow interior of the rotatable pressure roller, thereby selectively changing a temperature of the cylindrical sleeve of the pressure roller.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A temperature-changing pressure roller assembly for use in a heated fuser roller and pressure roller type fusing apparatus to form a fusing nip with the heated fuser roller, the temperature-changing pressure roller assembly comprising:

(a) a rotatable pressure roller including a cylindrical sleeve having an outer surface for forming the fusing nip with the heated fuser roller, and an inner surface defining a hollow interior to said rotatable pressure roller, said hollow interior having a first end and a second and opposite end;

(b) a vortex tube assembly for simultaneously producing a hot air stream and a cold air stream, said vortex tube assembly being connected to said hollow interior of said rotatable pressure roll; and (c) control means connected to said vortex tube assembly for selectively controlling flow of said hot air stream and said cold air stream thereof through said hollow interior of said rotatable pressure roller, thereby selectively changing a temperature of said cylindrical sleeve of said pressure roller for preventing image over-fusing.

2. The temperature-changing pressure roller assembly of claim 1, including an air moving device associated with said hollow interior for moving and flowing air controllably through said hollow interior and against said inner surface of said rotatable pressure roller.

3. The temperature-changing pressure roller assembly of claim 1, wherein said cylindrical sleeve is made of a heat conductive material.

4. The temperature-changing pressure roller assembly of claim 1, wherein said vortex tube assembly includes a hot air stream outlet port, a cold air stream outlet port, and a compressed air inlet port.

5. The temperature-changing pressure roller assembly of claim 4, including a source of compressed air connected to said compressed air inlet port.

6. The temperature-changing pressure roller assembly of claim 5, wherein said source of compressed air supplies compressed air at a pressure of about 80 psi.

7. The temperature-changing pressure roller assembly of claim 4, including a set of air flow conduits connecting said hot air stream outlet port to said interior of said rotatable pressure roller.

8. The temperature-changing pressure roller assembly of claim 7, wherein said control means includes a 3-way control valve.

9. The temperature-changing pressure roller assembly of claim 4, including a set of air flow conduits connecting said cold air stream outlet port to said interior of said rotatable pressure roller.

10. The temperature-changing pressure roller assembly of claim 9, wherein said control means includes a 3-way control valve.

11. The temperature-changing pressure roller assembly of claim 1, wherein said control means includes a temperature sensor positioned on said outer surface of said cylindrical sleeve for controlling operation of said vortex tube assembly.

12. A toner fusing apparatus comprising:

(a) a movable heated fuser roller having a first outer surface; and (b) a temperature-changing pressure roller assembly forming a fusing nip with said movable heated fuser roller, the temperature-changing pressure roller assembly including:

(i) a rotatable pressure roller including a cylindrical sleeve having a second outer surface forming said fusing nip against said first outer surface of said heated fuser roller, and an inner surface defining a hollow interior to said rotatable pressure roller, said hollow interior having a first end and a second and opposite end;

(ii) a vortex tube assembly for simultaneously producing a hot air stream and a cold air stream, said vortex tube assembly being connected to said hollow interior of said rotatable pressure roll; and (iii) control means connected to said vortex tube assembly for selectively controlling flow of said hot air stream and said cold air stream thereof through said hollow interior of said rotatable pressure roller, thereby selectively changing a temperature of said cylindrical sleeve of said pressure roller for preventing image over-fusing by the fusing apparatus.

13. The toner fusing apparatus of claim 12, including an air moving device associated with said hollow interior for moving and flowing air controllably through said hollow interior and against said inner surface of said rotatable pressure roller.

14. The toner fusing apparatus of claim 12, wherein said vortex tube assembly includes a hot air stream outlet port, a cold air stream outlet port, and a compressed air inlet port.

15. The toner fusing apparatus of claim 14, including a source of compressed air connected to said compressed air inlet port.

16. The toner fusing apparatus of claim 12, wherein said control means include a temperature sensor positioned on said outer surface of said cylindrical sleeve for controlling operation of said vortex tube assembly.

17. An electrostatographic reproduction machine comprising:

(a) a moveable imaging member including an imaging surface;

(b) latent imaging means for forming a latent electrostatic toner image on said imaging surface of said moveable imaging member;

(c) a development apparatus mounted adjacent to a path of movement of said moveable imaging member for developing said latent electrostatic image on said imaging surface into a toner image;

(d) a transfer station for transferring said toner image from said imaging surface onto a toner image carrying sheet; and (e) a heated fuser roller and pressure roller type fusing apparatus including a temperature-changing pressure roller assembly forming a fusing nip with the heated fuser roller, the temperature-changing pressure roller assembly comprising:

(i) a rotatable pressure roller including a cylindrical sleeve having a second outer surface forming said fusing nip against a first outer surface of said heated fuser roller, and an inner surface defining a hollow interior to said rotatable pressure roller, said hollow interior having a first end and a second and opposite end;

(ii) a vortex tube assembly for simultaneously producing a hot air stream and a cold air stream, said vortex tube assembly being connected to said hollow interior of said rotatable pressure roll; and (iii) control means connected to said vortex tube assembly for selectively controlling flow of said hot air stream and said cold air stream thereof through said hollow interior of said rotatable pressure roller, thereby selectively changing a temperature of said cylindrical sleeve of said pressure roller for preventing image over-fusing by the fusing apparatus.

18. The electrostatographic reproduction machine of claim 17, including an air moving device associated with said hollow interior for moving and flowing air controllably through said hollow interior and against said inner surface of said rotatable pressure roller.

19. The electrostatographic reproduction machine of claim 17, wherein said vortex tube assembly includes a hot air stream outlet port, a cold air stream outlet port, and a compressed air inlet port.

20. The electrostatographic reproduction machine of claim 17, wherein said control means includes a temperature sensor positioned on said outer surface of said cylindrical sleeve for controlling operation of said vortex tube assembly.

* * * * *